US010415423B2

(12) United States Patent
Kamoshida et al.

(10) Patent No.: US 10,415,423 B2
(45) Date of Patent: Sep. 17, 2019

(54) AUSTENITE STEEL, AND AUSTENITE STEEL CASTING USING SAME

(71) Applicants: MITSUBISHI HITACHI POWER SYSTEMS, LTD., Yokohama (JP); Tokyo Institute of Technology, Tokyo (JP)

(72) Inventors: Hironori Kamoshida, Yokohama (JP); Shinya Imano, Yokohama (JP); Masao Takeyama, Tokyo (JP)

(73) Assignee: MITSUBISHI HITACHI POWER SYSTEMS, LTD., Tokyo (JP)

( * ) Notice: Subject to any disclaimer, the term of this patent is extended or adjusted under 35 U.S.C. 154(b) by 386 days.

(21) Appl. No.: 15/349,383

(22) Filed: Nov. 11, 2016

(65) Prior Publication Data

US 2017/0130603 A1 May 11, 2017

(30) Foreign Application Priority Data

Nov. 11, 2015 (JP) ..... 2015-221317

(51) Int. Cl.

| | |
|---|---|
| ***C22C 38/08*** | (2006.01) |
| ***C22C 38/12*** | (2006.01) |
| ***C22C 38/14*** | (2006.01) |
| ***C22C 38/44*** | (2006.01) |
| ***C22C 38/48*** | (2006.01) |
| ***C22C 38/50*** | (2006.01) |
| ***F01D 25/00*** | (2006.01) |
| ***C22C 30/00*** | (2006.01) |
| ***F01D 17/14*** | (2006.01) |
| ***F01D 25/24*** | (2006.01) |
| ***C22C 38/54*** | (2006.01) |
| ***F01K 7/00*** | (2006.01) |

(52) U.S. Cl.

CPC ..... *F01D 25/005* (2013.01); *C22C 30/00* (2013.01); *C22C 38/08* (2013.01); *C22C 38/12* (2013.01); *C22C 38/14* (2013.01); *C22C 38/44* (2013.01); *C22C 38/48* (2013.01); *C22C 38/50* (2013.01); *C22C 38/54* (2013.01); *F01D 17/141* (2013.01); *F01D 25/24* (2013.01); *F01K 7/00* (2013.01); *F05D 2220/31* (2013.01); *F05D 2300/171* (2013.01)

(58) Field of Classification Search

None

See application file for complete search history.

(56) References Cited

U.S. PATENT DOCUMENTS

| | | | | |
|---|---|---|---|---|
| 3,046,108 | A | 7/1962 | Eiselstein | |
| 3,160,500 | A | 12/1964 | Eiselstein et al. | |
| 5,360,592 | A * | 11/1994 | Culling | C22C 30/00 420/582 |
| 6,372,181 | B1 * | 4/2002 | Fahrmann | C22C 30/00 148/442 |
| 8,506,884 | B2 * | 8/2013 | Haruyama | C22C 30/00 420/583 |
| 8,512,488 | B2 * | 8/2013 | Imano | C22F 1/10 148/677 |
| 8,685,316 | B2 * | 4/2014 | Sato | C22C 19/05 416/244 R |
| 2007/0217941 | A1 * | 9/2007 | Hayashi | C22C 38/48 420/38 |
| 2008/0257457 | A1 | 10/2008 | Cao et al. | |
| 2009/0081074 | A1 * | 3/2009 | Barbosa | C22C 30/00 420/584.1 |
| 2014/0086785 | A1 * | 3/2014 | Claude | C22C 38/08 420/47 |
| 2015/0203944 | A1 * | 7/2015 | Mentz | C22C 30/00 428/586 |
| 2017/0314106 | A1 * | 11/2017 | Oinuma | C22C 38/54 |

FOREIGN PATENT DOCUMENTS

| | | | |
|---|---|---|---|
| DE | 3011432 | A1 | 3/1980 |
| EP | 1502966 | A2 | 2/2005 |
| GB | 2054647 | A | 2/1981 |
| JP | 61-147836 | A | 7/1986 |
| JP | H04341538 | A | 4/1992 |
| JP | H10298682 | A | 10/1998 |
| JP | 2011-195880 | A | 10/2011 |
| JP | 2012-046796 | A | 3/2012 |
| WO | 2006111520 | A1 | 10/2006 |
| WO | 2008012842 | A1 | 1/2008 |

OTHER PUBLICATIONS

English translation of JP 04/341538, Nov. 1992; 4 pages.*

European Search Report for Application No. 16002373.5 dated Feb. 15, 2017.

* cited by examiner

*Primary Examiner* — Helene Klemanski

(74) *Attorney, Agent, or Firm* — Volpe and Koenig, P.C.

(57) ABSTRACT

Provided herein are an austenite steel that satisfies desirable strength and desirable castability at the same time, and an austenite steel casting using same. The austenite steel according to an embodiment of the present invention contains Ni: 25 to 50%, Nb: 3.8 to 6.0%, Zr: 0.5% or less, B: 0.001 to 0.05%, Cr: 12 to 25%, Ti: 1.6% or less, Mo: 4.8% or less, and W: 5.2% or less in mass %, and the balance Fe and unavoidable impurities, wherein the parameter Ps represented by the following formula (1) satisfies Ps≤38, $$Ps=8.3[Nb]-7.5[Ti]+2.4[Mo]+3.5[W] \quad \text{formula (1)},$$

where [Nb], [Ti], [Mo], and [W] represent the contents of Nb, Ti, Mo, and W, respectively, in mass %.

18 Claims, 2 Drawing Sheets

AUSTENITE STEEL, AND AUSTENITE STEEL CASTING USING SAME

CLAIM OF PRIORITY

The present application claims priority from Japanese Patent application serial No. 2015-221317, filed on Nov. 11, 2015, the content of which is hereby incorporated by reference into this application.

BACKGROUND OF THE INVENTION

1. Field of the Invention

The present invention relates to austenite steels and austenite steel castings using same, and particularly to high-strength heat-resistant austenite steels used for constituent members of thermal power plants or other applications.

2. Background Art

There have been efforts to increase steam temperature for improved efficiency of coal-fired power plants. At present, the highest steam temperature is achieved in a class of coal-fired power plants using USC (Ultra Super Critical) steam turbines, which are operated at a steam temperature of around 620° C. However, this temperature is expected to increase to reduce $CO_2$ emissions. To date, 9Cr and 12Cr heat-resistant ferrite steels have been commonly used for high-temperature members of steam turbines. However, it is believed that use of these steels will be difficult in the future as the steam temperature continues to increase.

A Ni base alloy having a higher working temperature than ferritic steels is a possible candidate alloy of high-temperature members. Ni base alloys contain Al and Ti as alloying elements, and show desirable high-temperature strength because the strengthened phase is the γ' phase that is stable at high temperatures. As for forging materials, γ'-phase precipitation strengthened alloy is melted as a material ingot using a melting method that involves sophisticated atmosphere control, such as VIM (Vacuum-Induction Melting), ESR (Electroslag Remelting), and VAR (Vacuum-Arc Remelting), and hot forged to produce a product material. In these melting methods, oxidation of active elements Al and Ti during a melting process is prevented by performing the process in a vacuum or by using a slug. In turbine casings and valve casings, the material is typically cast into a shape that relatively resembles the product using a sand mold, and used as a cast material as it is cast. In the casting method, however, melting involves an insufficient barrier against air, and the active elements (Al and Ti) become oxidized when these elements are contained in large amounts.

U.S. Pat. Nos. 3,046,108 and 3,160,500, for example, describe Alloy 625 as an alloy that is applicable to cast materials. This alloy is a solid solution hardening alloy involving a solid solution of Mo and Nb, and can be used as a desirable casting material to also produce thick members without causing defects. It has been confirmed that this alloy has a significantly higher creep capability temperature than common ferritic steels.

JP-A-2012-46796 and JP-A-2011-195880 propose non-γ' phase precipitation strengthened austenite steels. These are austenite steels that are hardened by precipitation strengthening using intermetallic compounds containing Nb as an alloying element, and show high-temperature strength as $Ni_3Nb$ and $Fe_2Nb$ precipitate in the grains and in grain boundaries. These materials are produced by melting the material ingot, and used as boiler materials after being processed (hot working).

JP-A-61-147836 proposes a corrosion-resistant austenite steel. This steel is described as having desirable high-temperature strength.

In the production of castings such as turbine casings and valve casings, a molten metal is poured into a mold using a technique such as AOD (Argon Oxygen Decarburization). However, melting of an alloy containing active elements such as Al and Ti, specifically a γ'-phase precipitation strengthened alloy, using this method may result in insufficient high-temperature strength as a result of oxidation of these active elements, which produces Al and Ti contents different from the predetermined contents, or produces oxides that interfere with the process.

The Alloy 625 of U.S. Pat. Nos. 3,046,108 and 3,160,500 is desirable in terms of productivity; however, the proof strength is insufficient, and deformation or loss may occur in a bolted screw when used for, for example, casings. Another drawback is that, when designing a high-strength alloy using a solid solution hardening alloy as a base alloy, the alloy requires further addition of solid solution hardening elements (for example, Mo and Nb). This may result in poor phase stability, causing precipitation of a harmful phase, and problems in long-term phase stability (mechanical characteristics).

The precipitation strengthened alloys of JP-A-2012-46796, JP-A-2011-195880, and JP-A-61-147836 require processes such as forging after the casting process, and are not easily applicable to castings, for example, such as casings.

The γ'-phase precipitation strengthened alloys having high-temperature strength cannot be easily used for castings (particularly, large castings), as described above. The low proof strength of the solid solution hardening alloys is also an issue. In casting production, castability also needs to be considered because macro defects, when occurred frequently during the casting, lead to poor product reliability.

SUMMARY OF THE INVENTION

The present invention was made under these circumstances, and an object of the present invention is to provide an austenite steel that satisfies desirable strength and desirable castability at the same time. The invention is also intended to provide an austenite steel casting using same.

In order to achieve the foregoing object, a first aspect of the present invention provides an austenite steel containing Ni: 25 to 50%, Nb: 3.8 to 6.0%, Zr: 0.5% or less, B: 0.001 to 0.05%, Cr: 12 to 25%, Ti: 1.6% or less, Mo: 4.8% or less, and W: 5.2% or less in mass %, and the balance Fe and unavoidable impurities, wherein the parameter Ps represented by the following formula (1) satisfies Ps≤38, $$Ps=8.3[Nb]-7.5[Ti]+2.4[Mo]+3.5[W] \quad \text{formula (1)},$$

where [Nb], [Ti], [Mo], and [W] represent the contents of Nb, Ti, Mo, and W, respectively, in mass %.

In order to achieve the foregoing object, a second aspect of the present invention provides an austenite steel containing Ni: 30 to 45%, Nb: 3.8 to 5.0%, B: 0.001 to 0.05%, Cr: 12 to 25%, Ti: 1.0% or less, Mo: 4.8% or less, and W: 5.2% or less in mass %, and the balance Fe and unavoidable impurities, wherein the parameter Ps represented by the foregoing formula (1) satisfies 27≤Ps≤38.

In order to achieve the foregoing object, a third aspect of the present invention provides an austenite steel containing Ni: 30 to 40%, Nb: 3.8 to 4.9%, B: 0.001 to 0.05%, Cr: 15 to 20%, Ti: 1.0% or less, Mo: 3.4% or less, and W: 3.2% or less in mass %, and the balance Fe and unavoidable impurities, wherein the parameter Ps represented by the foregoing formula (1) satisfies $27 \leq Ps \leq 38$.

The present invention is also intended to provide an austenite steel casting using the austenite steel according to any of the foregoing aspects of the present invention.

The present invention can provide an austenite steel that satisfies desirable strength and desirable castability at the same time, and an austenite steel casting using same.

DESCRIPTION OF THE PREFERRED EMBODIMENT

Figure 1:
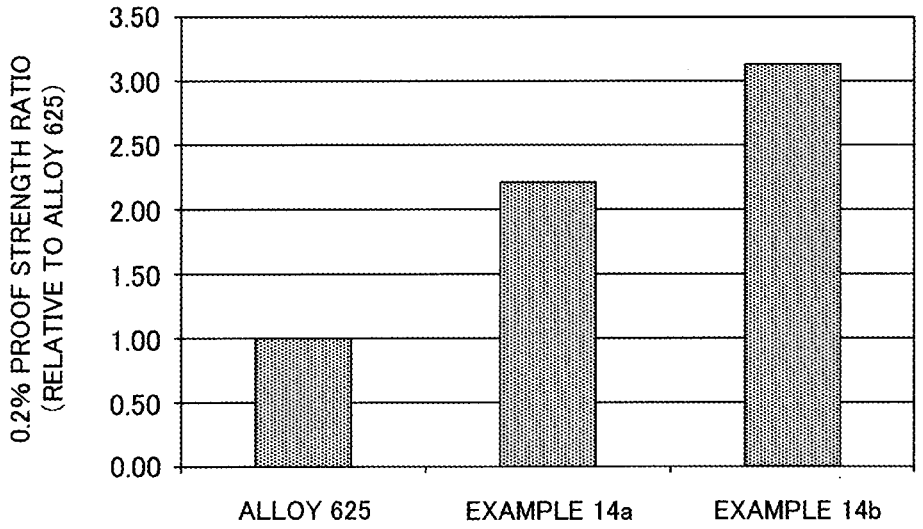
FIG. 1 is a graph representing the 0.2% proof strength ratios of Examples 14a and 14b (relative to Alloy 625).

An embodiment of the present invention is described below in detail. However, the present invention is not limited to the following embodiment, and various modifications and changes may be made thereto within the gist of the invention.

Austenite Steel

An austenite steel according to an embodiment of the present invention uses intermetallic compounds of Nb as a strengthening factor, instead of using active (easily oxidizable) elements, such as Al and Ti, as a main strengthening factor. The austenite steel according to the embodiment of the present invention has a novel composition, and satisfies desirable strength and desirable castability at the same time. The composition (component ranges) of the austenite steel according to the embodiment of the present invention is described below. In the descriptions of the composition below, "%" means "mass %", unless otherwise specifically stated.

Ni (Nickel): 25 to 50%

Ni contributes to grain boundary strengthening as an austenite stabilizing element, or by precipitating in the grains in the form of an intermetallic compound with Nb (δ phase, $Ni_3Nb$), as will be described later. Desirably, Ni is 30 to 45% (30% or more and 45% or less) from the viewpoint of phase stability. More desirably, Ni is 30 to 40%.

Cr (Chromium): 12 to 25%

Cr is an element that improves the oxidation and steam oxidation resistance. Considering the operating temperatures of steam turbines, the oxidation characteristics become adversely affected when the Cr content is less than 12%. When added in an amount larger than 25%, Cr causes precipitation of intermetallic compounds such as the σ phase. This leads to poor high-temperature ductility or weakened toughness. Considering the balance between these qualities, the Cr content is desirably 15 to 20%.

Nb (Niobium): 3.8 to 6.0%

Nb is added to stabilize the Laves phase ($Fe_2Nb$) and the δ phase ($Ni_3Nb$). The Laves phase precipitates mainly at the grain boundaries, and contributes to grain boundary strengthening. The δ phase precipitates mainly in the grains, and contributes to strengthening. When the Nb content is less than 3.8%, the high-temperature creep strength becomes insufficient. The castability becomes seriously impaired when the Nb content exceeds 6.0%. The Nb content is desirably 4.0% or more in terms of obtaining sufficient strength. Considering castability, the Nb content is desirably 5.0% or less, more desirably 4.9% or less.

B (Boron): 0.001 to 0.05%

Boron contributes to precipitation of the Laves phase at the grain boundaries. When B is not added, the Laves phase becomes less likely to precipitate at the grain boundaries, and the creep strength and the creep ductility suffer. Boron develops the grain boundary precipitation effect when added in an amount of 0.001% or more. When added in excess amounts, the element causes melting point locally due to micro-segregation, and poses the risk of, for example, poor weldability. Considering these, the B content needs to be 0.05% or less. More desirably, the B content is 0.01% or less.

Zr (Zirconium): 0 to 0.5%

Zr contributes to precipitation of the Laves phase at the grain boundaries, as does boron, and to precipitation of the γ" phase ($Ni_3Nb$). The effects become particularly prominent in short terms or at low temperatures (less than 750° C., desirably 700° C. or less). However, because of the metastable phase, a transition to the δ phase occurs when a high temperature (particularly, 750° C. or more) is maintained for extended time periods. It is therefore not required to add this element. The upper limit is 0.5% because excess amounts of Zr lead to poor weldability.

Ti (Titanium): 0 to 1.6%

Ti is an element that contributes to intragranular precipitation strengthening, such as in the γ" phase and the δ phase. When added in appropriate amounts, Ti can greatly reduce the initial creep deformation. In casting applications, this element has the effect to reduce generation of segregation defects. However, when added in excess amounts, oxidation becomes a factor during production, and the mechanical characteristics are adversely affected, as described above. The Ti content is desirably 1.0% or less, more desirably 0.9% or less.

Mo (Molybdenum): 0 to 4.8%

Mo contributes to stabilization of the Laves phase, in addition to solid solution hardening. By adding Mo, the Laves phase precipitates in increased amounts at the grain boundaries, and this contributes high strength and ductility in long-term creep characteristics. The Mo content is preferably 3.4% or less.

W (Tungsten): 0 to 5.2%

W contributes to stabilization of the Laves phase, in addition to solid solution hardening. By adding W, the Laves phase precipitates in increased amounts at the grain boundaries, and this contributes high strength and ductility in long-term creep characteristics. Castability suffers, and defects tend to occur when the W content exceeds 5.2%. The W content is preferably 3.2% or less.

In order to obtain desirable castability, the austenite steel according to the embodiment of the present invention needs to have a parameter Ps of the foregoing formula (1) satisfying $Ps \leq 38$, in addition to the foregoing composition. The following describes the parameter Ps. The present inventors focused on the molten metal density difference at solidification (hereinafter, denoted as "$|\Delta\rho|$") as an index of castability. The index $|\Delta\rho|$ is the density difference of molten metals occurring in the vicinity of the solidification interface when solidified. Specifically, the index $|\Delta\rho|$ represents the density difference between two liquid phases: a liquid phase in the vicinity of the solidification interface of when the solid phase ratio reaches 0.35 after the start of solidification, and a liquid phase located at a sufficient distance from the solid-liquid interface. The index $|\Delta\rho|$ depends on the solid-liquid distribution of each element. When the solid phase ratio is 0.35 or more, the solid phase inhibits large movement of the liquid phase, and Freckel defects become unlikely to occur. The index $|\Delta\rho|$ at the solid phase ratio of 0.35 can thus be used as an index of castability.

It has been confirmed that the Alloy 625 is castable without causing macro defects, even in large casting applications (for example, a thickness of 300 mm). It follows from this that production of large castings would be possible when the index $|\Delta\rho|$ is smaller than that of Alloy 625. Thermodynamic calculations have found that the $|\Delta\rho|$ of Alloy 625 is 0.0365 g/cm$^3$. Accordingly, it would be possible to produce a large casting of desirable castability by making the $|\Delta\rho|$ of the austenite steel smaller than that of Alloy 625. When $|\Delta\rho|$ is too large, macro defects occurs as the liquid phase of a component greatly differing from the whole other components at the solidification interface moves upward and downward. This leads to poor castability.

The parameter Ps according to the present invention is a parameter derived from the relation between $|\Delta\rho|$ and the Nb, Ti, Mo, and W contents. Fe, Cr, and Ni do not have large effect on $|\Delta\rho|$ because these elements have hardly any solid-liquid distribution during solidification, and are almost equally distributed. However, it was found that Ti, Nb, Mo, and W are distributed more toward the liquid phase in the present component system. The index $|\Delta\rho|$ can thus be adjusted by adjusting these elements. Studies found that the index $|\Delta\rho|$ satisfies $|\Delta\rho|<0.0365$ g/cm$^3$, and desirable castability can be obtained when the parameter Ps of the present invention is 38 or less. As used herein, "desirable castability" means that the castability is comparable to or even better than that of Alloy 625.

The foregoing component ranges specify the preferred ranges of each element from the standpoint of strength and phase equilibrium. It was found that desirable castability can be obtained when the parameter Ps satisfies $Ps\leq 38$. The Ps range is more preferably $27\leq Ps\leq 38$.

An austenite steel having desirable strength and desirable castability can be obtained by satisfying the foregoing component ranges and the parameter Ps.

Austenite Steel Casting

An austenite steel casting produced with the austenite steel according to the embodiment of the present invention is described below. The austenite steel casting according to the embodiment of the present invention is preferred for use in members having a large complex structure and requiring high strength in high temperatures.

Figure 3:
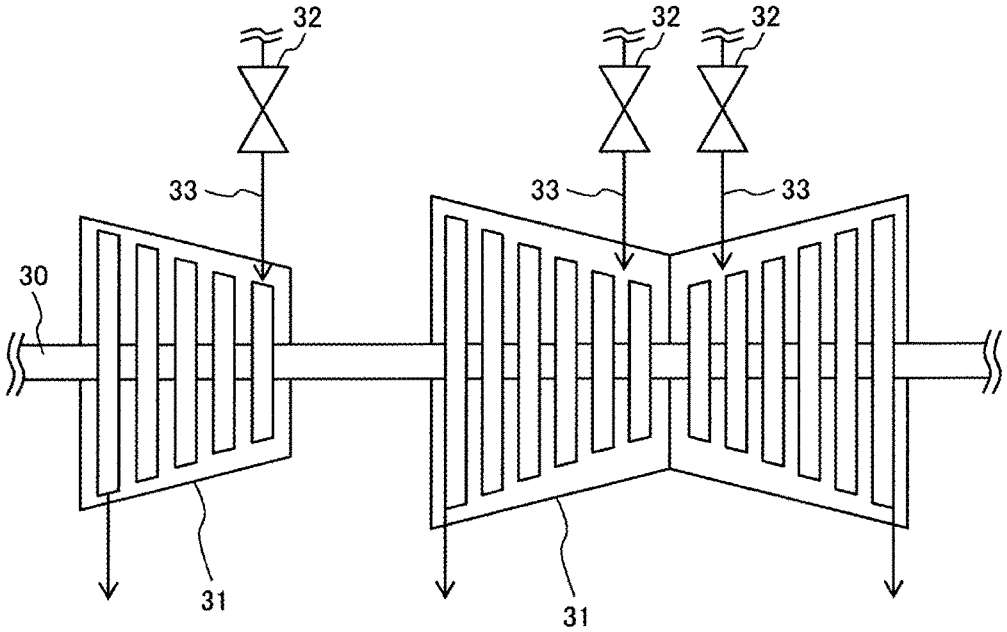
FIG. 3 is a schematic view illustrating an example of a high-temperature portion of a steam turbine for power generating plants.

FIG. 3 is a schematic view representing an example of a high-temperature portion of a steam turbine for power generating plants. The casting is, for example, a turbine casing 31 constituting a steam turbine for power generating plants (a turbine casing 31 covering a turbine rotor 30) shown in FIG. 3. The turbine casing 31 is a member with a large complex shape, and is produced by casting. The turbine casing 31 is also exposed to a high-temperature steam 33. The turbine casing 31 weighs at least 1 ton, and may exceed 10 tons in some variations. The thickness is non-uniform, with a thinner portion exceeding 50 mm, and thicker portions as thick as 200 mm, or even thicker. Because the turbine casting 31 is a large thick member, defects occurs, and the reliability greatly suffers when the material has poor castability with a slow casting solidification rate (for example, a material having a larger $|\Delta\rho|$ than Alloy 625). The austenite steel according to the embodiment of the present invention has desirable strength and desirable castability. The austenite steel can thus provide a casting that involves a few segregation defects, even when produced as a member having thick portions (with a thickness of 50 mm), which are prone to segregation, or as a large member heavier than 1 ton.

The austenite steel casting according to the embodiment of the present invention is also preferred for use as a casing for valves used to pass, stop, or adjust a steam, though not illustrated in FIG. 3. The austenite steel according to the embodiment of the present invention is not limited to applications to members such as above, and is also preferred as any member that requires high-temperature strength.

EXAMPLES

Austenite steels within the present invention (Examples 1 to 18), and austenite steels outside the present invention (Comparative Examples 1 to 10) were produced, and evaluated for castability (Ps) and strength. The compositions, Ps, and $|\Delta\rho|$ of Examples 1 to 18 and Comparative Examples 1 to 10 are shown in Table 1. It is to be noted that B and Zr are excluded from calculations because these are contained in trace amounts (B: 0.006 mass %, Zr: 0.16 mass %), and do not have large effect on $|\Delta\rho|$.

TABLE 1

| | Chemical components (mass %) | | | | | | | | $\lvert\Delta\rho\rvert$ |
|---|---|---|---|---|---|---|---|---|---|
| | Fe | Cr | Ni | Nb | Ti | Mo | W | Ps | (g/cm$^3$) |
| Ex. 1 | bal. | 17.9 | 39.4 | 4.01 | 0.83 | 1.65 | 1.59 | 36.6 | 0.0333 |
| Ex. 2 | bal. | 18.2 | 36.6 | 5.30 | 0.84 | 0.00 | 0.00 | 37.7 | 0.0355 |
| Ex. 3 | bal. | 18.2 | 37.0 | 4.89 | 0.84 | 0.00 | 0.00 | 34.3 | 0.0323 |
| Ex. 4 | bal. | 18.3 | 37.0 | 5.00 | 1.00 | 0.00 | 0.00 | 34.0 | 0.0323 |
| Ex. 5 | bal. | 18.3 | 37.6 | 4.75 | 0.50 | 0.00 | 0.00 | 35.7 | 0.0339 |
| Ex. 6 | bal. | 18.3 | 37.4 | 5.00 | 0.50 | 0.00 | 0.00 | 37.8 | 0.0362 |
| Ex. 7 | bal. | 18.3 | 37.4 | 5.00 | 0.75 | 0.00 | 0.00 | 35.9 | 0.0342 |
| Ex. 8 | bal. | 18.3 | 37.8 | 4.00 | 1.00 | 0.00 | 0.00 | 25.7 | 0.0232 |
| Ex. 9 | bal. | 18.1 | 35.8 | 4.05 | 0.84 | 1.67 | 0.00 | 31.4 | 0.0298 |
| Ex. 10 | bal. | 18.0 | 35.6 | 4.02 | 0.83 | 3.32 | 0.00 | 35.2 | 0.0342 |
| Ex. 11 | bal. | 17.9 | 36.0 | 4.01 | 0.83 | 4.14 | 0.00 | 37.0 | 0.0357 |
| Ex. 12 | bal. | 17.9 | 36.3 | 3.99 | 0.82 | 0.00 | 3.16 | 38.0 | 0.0333 |
| Ex. 13 | bal. | 17.9 | 39.4 | 4.01 | 0.83 | 1.65 | 1.59 | 36.6 | 0.0333 |
| Ex. 14 | bal. | 18.3 | 36.1 | 4.08 | 0.84 | 0.00 | 0.00 | 27.6 | 0.0262 |
| Ex. 15 | bal. | 22.3 | 28.9 | 6.00 | 1.59 | 0.00 | 0.00 | 37.9 | 0.0342 |
| Ex. 16 | bal. | 15.8 | 49.0 | 3.80 | 1.58 | 0.00 | 5.20 | 37.9 | 0.0177 |
| Ex. 17 | bal. | 18.4 | 40.9 | 3.95 | 0.90 | 4.80 | 0.00 | 37.6 | 0.0362 |
| Ex. 18 | bal. | 18.2 | 37.0 | 4.07 | 0.00 | 0.00 | 0.00 | 33.8 | 0.0363 |
| Com. Ex. 1 | bal. | 17.8 | 32.1 | 4.00 | 0.82 | 1.64 | 3.14 | 42.0 | 0.0384 |
| Com. Ex. 2 | bal. | 17.7 | 32.0 | 3.94 | 0.81 | 3.26 | 3.12 | 45.4 | 0.0425 |

TABLE 1-continued

| | Chemical components (mass %) | | | | | | | | $\lvert\Delta\rho\rvert$ |
|---|---|---|---|---|---|---|---|---|---|
| | Fe | Cr | Ni | Nb | Ti | Mo | W | Ps | (g/cm$^3$) |
| Com. Ex. 3 | bal. | 17.4 | 31.5 | 3.88 | 0.80 | 1.60 | 6.15 | 51.6 | 0.0446 |
| Com. Ex. 4 | bal. | 18.2 | 36.5 | 5.52 | 0.84 | 0.00 | 0.00 | 39.5 | 0.0373 |
| Com. Ex. 5 | bal. | 18.1 | 36.9 | 5.67 | 0.84 | 0.00 | 0.00 | 40.8 | 0.0402 |
| Com. Ex. 6 | bal. | 18.3 | 36.8 | 5.50 | 1.00 | 0.00 | 0.00 | 38.2 | 0.0372 |
| Com. Ex. 7 | bal. | 17.9 | 37.0 | 4.00 | 0.82 | 4.95 | 0.00 | 38.9 | 0.0373 |
| Com. Ex. 8 | bal. | 17.8 | 35.1 | 3.97 | 0.82 | 0.00 | 4.08 | 41.1 | 0.0370 |
| Com. Ex. 9 | bal. | 17.5 | 35.5 | 3.90 | 0.81 | 0.00 | 6.18 | 48.0 | 0.0452 |
| Com. Ex. 10 | 1.0 | 21.7 | bal. | 3.51 | 0.20 | 8.93 | 0.00 | — | 0.0365 |

As can be seen in Table 1, the parameter Ps was 38 or less, and the corresponding $\lvert\Delta\rho\rvert$ value was less than 0.0365 in all of Examples 1 to 18. It can be said from this that the castability is desirable. On the other hand, the index value $\lvert\Delta\rho\rvert$ was equal to or greater than the $\lvert\Delta\rho\rvert$ value of Alloy 625 (0.0365 g/cm$^3$) in Comparative Examples 1 to 10 in which the parameter Ps was greater than 38. These steels are thus more likely to produce defects than Alloy 625 when used to produce large castings, and are not desirable as material of a high-quality casting.

Figure 2:
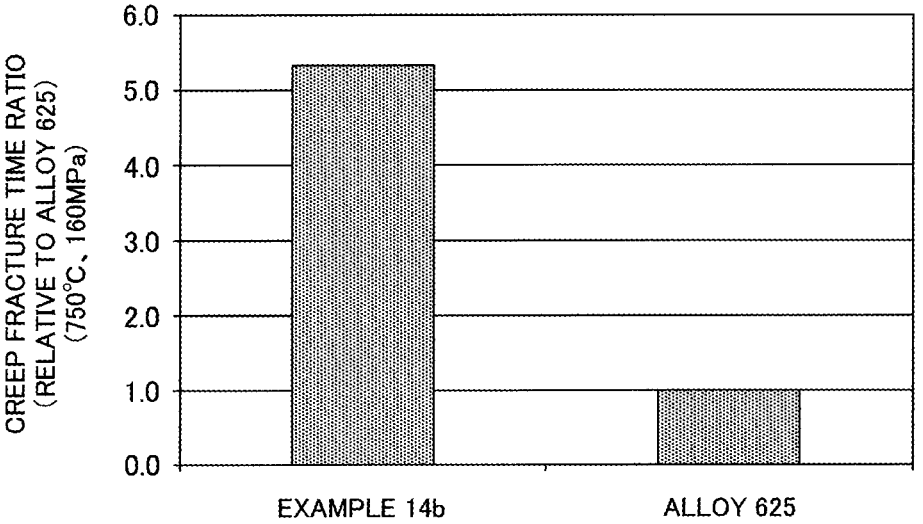
FIG. 2 is a graph representing the creep fracture time ratio of Example 14b (relative to Alloy 625).

The results of the strength evaluation of the austenite steels according to the present invention are described below. The components in Example 14 of Table 1 were used to produce ingots through two different aging heat treatments (a high-temperature heat treatment (Example 14a), and a low-temperature heat treatment (Example 14b)), and the strength was evaluated (tensile test, creep test). FIG. 1 is a graph representing the 0.2% proof strength ratios of Examples 14a and 14b, and Alloy 625 (relative to Alloy 625). FIG. 2 is a graph representing the creep fracture time ratios of Example 14b and Alloy 625 (relative to Alloy 625). The creep test was conducted at 750° C. under 160 MPa.

As shown in FIG. 1, the 0.2% proof strength ratio was about 2.2 times higher in Example 14a subjected to a high-temperature aging treatment, and about 3 times higher in Example 14b subjected to a low-temperature aging treatment than in Alloy 625. The improved properties of Examples 14a and 14b are the result of the precipitation of intermetallic compounds in the aging heat treatments, and the resulting large improvement of proof strength over the traditional material (Alloy 625).

It can be seen in FIG. 2 that the creep life in Example 14b is more than 5 times longer than that of Alloy 625, showing that the creep strength is more desirable than that of the traditional material (Alloy 625).

As demonstrated above, the present invention can provide an austenite steel that satisfies desirable high-temperature strength and desirable castability at the same time, and an austenite steel casting member using the austenite steel.

The specific descriptions of the foregoing Examples are intended to help understand the present invention, and the present invention is not limited to having all the configurations described above. For example, a part of the configuration of a certain Example may be replaced with the configuration of some other Example, or the configuration of a certain Example may be added to the configuration of some other Example. It is also possible to delete a part of the configuration of any of the Examples, or replace a part of the configuration with other configuration, or add other configurations.

EXPLANATION OF REFERENCE CHARACTERS

30 . . . turbine rotor, 31 . . . turbine casing, 32 . . . valve, 33 . . . steam

What is claimed is:

1. An austenite steel consisting of:
Ni in an amount of 25 to 50% by mass;
Nb in an amount of 3.8 to 6.0% by mass;
Zr in an amount of 0.5% or less by mass;
B in an amount of 0.001 to 0.05% by mass;
Cr in an amount of 12 to 25% by mass;
Ti in an amount of 1.6% or less by mass;
Mo in an amount of 4.8% or less by mass;
W in an amount of 5.2% or less by mass; and
Fe and unavoidable impurities in an amount of a remaining balance of the austenite steel,
wherein the austenite steel satisfies:
$Ps \leq 38$, and $$Ps=8.3[Nb]-7.5[Ti]+2.4[Mo]+3.5[W]$$

where [Nb], [Ti], [Mo], and [W] represent mass % of Nb, Ti, Mo, and W, respectively.

2. An austenite steel consisting of:
Ni in an amount of 30 to 45% by mass;
Nb in an amount of 3.8 to 5.0% by mass;
B in an amount of 0.001 to 0.05% by mass;
Cr in an amount of 12 to 25% by mass;
Ti in an amount of 1.0% or less by mass;
Mo in an amount of 4.8% or less by mass; and
W in an amount of 5.2% or less by mass; and
Fe and unavoidable impurities in an amount of a remaining balance of the austenite steel,
wherein the austenite steel satisfies
$27 \leq Ps \leq 38$, and $$Ps=8.3[Nb]-7.5[Ti]+2.4[Mo]+3.5[W]$$

where [Nb], [Ti], [Mo], and [W] represent mass % of Nb, Ti, Mo, and W, respectively.

3. An austenite steel consisting of:
Ni in an amount of 30 to 40% by mass;
Nb in an amount of 3.8 to 4.9% by mass;
B in an amount of 0.001 to 0.05% by mass;
Cr in an amount of 15 to 20% by mass;
Ti in an amount of 1.0% or less by mass;
Mo in an amount of 3.4% or less by mass;
W in an amount of 3.2% or less by mass; and
Fe and unavoidable impurities in an amount of a remaining balance of the austenite steel,
wherein the austenite steel satisfies:
$27 \leq Ps \leq 38$, and $$Ps=8.3[Nb]-7.5[Ti]+2.4[Mo]+3.5[W],$$

where [Nb], [Ti], [Mo], and [W] represent mass % of Nb, Ti, Mo, and W, respectively.

4. A austenite steel casting formed from the austenite steel of claim 1.

5. The austenite steel casting according to claim 4, wherein the austenite steel casting has a thickness of 50 mm or more.

6. The austenite steel casting according to claim 4, wherein the austenite steel casting weighs at least 1 ton.

7. The austenite steel casting according to claim 4, wherein the austenite steel casting is a constituent member of a steam turbine for power generating plants.

8. The austenite steel casting according to claim 7, wherein the constituent member is a turbine casing or a valve casing.

9. A austenite steel casting formed from the austenite steel of claim 2.

10. The austenite steel casting according to claim 9, wherein the austenite steel casting has a thickness of 50 mm or more.

11. The austenite steel casting according to claim 9, wherein the austenite steel casting weighs at least 1 ton.

12. The austenite steel casting according to claim 9, wherein the austenite steel casting is a constituent member of a steam turbine for power generating plants.

13. The austenite steel casting according to claim 12, wherein the constituent member is a turbine casing or a valve casing.

14. A austenite steel casting formed from the austenite steel of claim 3.

15. The austenite steel casting according to claim 14, wherein the austenite steel casting has a thickness of 50 mm or more.

16. The austenite steel casting according to claim 14, wherein the austenite steel casting weighs at least 1 ton.

17. The austenite steel casting according to claim 14, wherein the austenite steel casting is a constituent member of a steam turbine for power generating plants.

18. The austenite steel casting according to claim 17, wherein the constituent member is a turbine casing or a valve casing.

* * * * *